US010961882B2

(12) United States Patent
Yokota et al.

(10) Patent No.: US 10,961,882 B2
(45) Date of Patent: Mar. 30, 2021

(54) INTERNAL COMBUSTION ENGINE

(71) Applicant: HONDA MOTOR CO., LTD., Tokyo (JP)

(72) Inventors: Hiroshi Yokota, Wako (JP); Yoshiyuki Ikebe, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 16/496,482

(22) PCT Filed: Mar. 23, 2017

(86) PCT No.: PCT/JP2017/011739

§ 371 (c)(1),
(2) Date: Sep. 23, 2019

(87) PCT Pub. No.: WO2018/173198

PCT Pub. Date: Sep. 27, 2018

(65) Prior Publication Data

US 2020/0025047 A1 Jan. 23, 2020

(51) Int. Cl.

| | |
|---|---|
| ***F01M 11/02*** | (2006.01) |
| ***F01M 11/12*** | (2006.01) |
| ***F01M 11/04*** | (2006.01) |
| ***F01M 11/00*** | (2006.01) |

(52) U.S. Cl.
CPC ..... *F01M 11/0458* (2013.01); *F01M 11/0004* (2013.01); *F01M 11/02* (2013.01); *F01M 11/12* (2013.01); *F01M 2011/0037* (2013.01)

(58) Field of Classification Search
CPC ..... F01M 11/02; F01M 11/0004; F01M 11/12
See application file for complete search history.

(56) References Cited

U.S. PATENT DOCUMENTS

| | | | |
|---|---|---|---|
| 6,073,618 | A | 6/2000 | Sanders et al. |
| 6,935,298 | B2 | 8/2005 | Ueshima et al. |
| 2004/0079343 | A1 | 4/2004 | Stenz et al. |

(Continued)

FOREIGN PATENT DOCUMENTS

| | | | |
|---|---|---|---|
| JP | S57-51112 | U | 3/1982 |
| JP | H02-230913 | A | 9/1990 |

(Continued)

OTHER PUBLICATIONS

Office Action, with a dispatch dated Jan. 1, 2021, issued over the corresponding Indian Patent Application No. 201917037199.

*Primary Examiner* — Long T Tran
(74) *Attorney, Agent, or Firm* — Carrier Blackman & Associates, P.C.; William D. Blackman; Joseph P. Carrier

(57) ABSTRACT

There is provided an internal combustion engine in which oil can be kept in an oil passageway when oil is supplied, so that the time required to supply oil can be reduced. In an internal combustion engine in which an oil supply inlet for replenishing, with oil, an oil pan reservoir chamber disposed in a lower portion of a crankcase extends obliquely downwardly from an oil supply port at an upper end thereof, the oil pan reservoir chamber has an oil pan inlet port disposed in a position offset from a vertical plane, including the oblique oil supply inlet, and a horizontal oil supply passageway bent and extending substantially horizontally from a lower end of the oil supply inlet is connected to the oil pan inlet port.

13 Claims, 10 Drawing Sheets

(56) References Cited

U.S. PATENT DOCUMENTS

| | | | | |
|---|---|---|---|---|
| 2006/0174851 | A1* | 8/2006 | Furuya | F01L 1/02 123/196 R |
| 2007/0251229 | A1* | 11/2007 | Nakatsuka | F16H 47/02 60/435 |
| 2007/0272193 | A1* | 11/2007 | Muramatsu | F01M 11/0004 123/196 R |
| 2010/0192900 | A1* | 8/2010 | Ohmori | F02F 7/0068 123/198 DA |
| 2014/0209053 | A1* | 7/2014 | Norrick | F01M 11/061 123/196 R |
| 2016/0369853 | A1* | 12/2016 | Sugiura | F01M 1/10 |
| 2019/0234260 | A1* | 8/2019 | VanDrie | F01M 11/0458 |

FOREIGN PATENT DOCUMENTS

| | | | |
|---|---|---|---|
| JP | 2003-328720 | A | 11/2003 |
| JP | 2009-191749 | A | 8/2009 |
| JP | 2010-242395 | A | 10/2010 |
| JP | 2015-197111 | A | 11/2015 |
| WO | 2016/039065 | A1 | 3/2016 |

* cited by examiner

INTERNAL COMBUSTION ENGINE

TECHNICAL FIELD

The present invention relates to an internal combustion engine that includes an oil inlet tube for supplying oil to an oil pan reservoir chamber.

BACKGROUND ART

Generally, an oil level gage is used to measure an amount of oil in an oil pan reservoir chamber. A gage insertion tube inserted with the oil level gage is held in fluid communication with the oil pan reservoir chamber. There is an example in which an oil supply inlet for supplying oil to the oil pan reservoir chamber is used as the gage insertion tube (see, for example, Patent Document 1).

PRIOR ART DOCUMENT

Patent Document

Patent Document 1: JP 2009-191749 A

Patent Document 1 discloses that an oil supply port at the upper end of an inclined oil supply inlet is closed by an oil filler cap, the oil filler cap has a dip stick projecting therefrom into the oil supply inlet, and the dip stick has a gage at a distal end thereof immersed below the surface of oil for marking the amount of oil thereon.

When the oil filler cap is removed, oil can be supplied from the oil supply port at the upper end of the oil supply inlet.

SUMMARY OF THE INVENTION

[Underlying Problem to be Solved by the Invention]

The oil supply inlet disclosed in Patent Document 1 extends obliquely downwardly from the oil supply port. A horizontal oil supply passageway bent and extending horizontally from the lower end of the oil supply inlet leads to an oil reservoir inlet port of an oil reservoir.

The inclined oil supply inlet and the horizontal oil supply passageway with the oil supply port and the oil reservoir inlet port are arranged substantially in a straight line as viewed in plan.

In other words, the oil reservoir inlet port is positioned on a vertical plane including the inclined oil supply inlet.

Therefore, the horizontal oil supply passageway runs the shortest distance between the oil supply inlet and a pan inlet port communicating with each other. Therefore, the horizontal oil supply passageway is of a short length.

However, the short horizontal oil supply passageway cannot be expected to keep oil therein when oil is introduced into the oil pan reservoir chamber. Therefore, it is necessary to introduce oil at a low rate to avoid overflowing. If a large amount of oil is to be kept in the oil pan reservoir chamber, then it takes time to supply oil to the oil pan reservoir chamber.

The present invention has been made in view of the above problems. It is an object of the present invention to provide an internal combustion engine which can keep oil in an oil passageway when oil is supplied to an oil pan reservoir chamber, so that the time required to supply oil to the oil pan reservoir chamber can be reduced.

Means to Solve the Problem

In order to achieve the above object, there is provided in accordance with the present invention an internal combustion engine having an oil supply inlet for replenishing, with oil, an oil pan reservoir chamber disposed in a lower portion of a crankcase, the oil supply inlet extending obliquely downwardly from an oil supply port at an upper end thereof, wherein the oil pan reservoir chamber has an oil pan inlet port disposed in a position offset from a vertical plane including the oblique oil supply inlet; and a horizontal oil supply passageway bent and extending substantially horizontally from a lower end of the oil supply inlet is connected to the oil pan inlet port.

With this arrangement, since the horizontal oil supply passageway bent and extending substantially horizontally from the lower end of the oil supply inlet that extends obliquely downwardly from the oil supply port at the upper end is connected to the oil pan inlet port disposed in the position offset from the vertical plane including the oblique oil supply inlet, the substantially horizontal oil supply passageway is made elongate, and the horizontal oil supply passageway can be expected to keep oil therein. It is not necessary to introduce oil at a low rate so as to avoid overflowing, and hence the time required to supply oil can be reduced.

In the above arrangement, the horizontal oil supply passageway may have an upstream end to which the oil supply inlet is connected, a cross-sectional plane of the upstream end may be of a trapezoidal shape having an upper side connected to the oil supply inlet longer than a lower side thereof.

With this arrangement, since oil that is introduced into the oil supply inlet flows into the upstream end, whose cross-sectional plane is of a trapezoidal shape where the upper side is longer than the lower side, of the upstream horizontal oil supply passageway, the oil which contains air trapped when the oil is introduced is constricted by the upstream end whose cross-sectional plane is of a tapered trapezoidal shape. Air-oil separation is thus promoted, and the separated air is restrained from entering the upstream horizontal oil supply passageway 72, and oil that contains air is prevented from entering the oil pan reservoir chamber as much as possible.

In the above arrangement, the horizontal oil supply passageway may have an upstream passageway portion near an upstream end thereof, the upstream passageway portion being connected to a downstream passageway portion thereof having a lower upper wall surface and a smaller cross-sectional area.

With this arrangement, inasmuch as the upstream passageway portion near the upstream end of the horizontal oil supply passageway is connected to the downstream passageway portion having the lower upper wall surface and the smaller cross-sectional area, even if air enters the upstream passageway portion, the air is restrained from entering the downstream passageway portion by a step where the upper wall surface is lower, and oil that contains air is prevented from entering the oil pan reservoir chamber as much as possible.

In the above arrangement, the oil supply inlet may be disposed in a crankcase cover coupled to the crankcase, and the horizontal oil supply passageway may extend in and across the crankcase cover and the crankcase.

With this arrangement, since the oil supply inlet is disposed in the crankcase cover coupled to the crankcase, and the horizontal oil supply passageway extends in and across the crankcase and the crankcase cover, alterations can easily be made depending on different shapes of portions of the oil passageway system.

In the above arrangement, an oil return passage for returning oil that has lubricated lubrication portions of the internal combustion engine may be joined to the horizontal oil supply passageway.

With this arrangement, as the oil return passageway for returning oil that has lubricated the lubrication portions of the internal combustion engine is joined to the horizontal oil supply passageway, the horizontal oil supply passageway may be used as part of the oil return passageway. As a result, the oil passageway system is simplified, making it possible to prevent the internal combustion engine from increasing in size.

In the above arrangement, the internal combustion engine may include an operating oil reservoir chamber separately from the oil pan reservoir chamber, in which the horizontal oil supply passageway may have an operating oil reservoir chamber inlet port defined in a downstream end thereof and leading to the operating oil reservoir chamber, separately from the oil pan inlet port.

With this arrangement, in the internal combustion engine that includes the operating oil reservoir chamber separately from the oil pan reservoir chamber, the operating oil reservoir chamber inlet port defined in the downstream end of the horizontal oil supply passageway and leading to the operating oil reservoir chamber, separately from the oil pan inlet port, makes it possible to alter, with ease, a structure for supplying oil to the operating oil reservoir chamber.

In the above arrangement, a gage insertion tube for the insertion of an oil level gage therein may be disposed in the crankcase cover, separately from the oil supply inlet.

With this arrangement, since the gage insertion tube for the insertion of the oil level gage therein is disposed in the crankcase cover separately from the oil supply inlet, the oil supply inlet does not need to be set to a length equal or larger than the length of the oil level gage and can be placed in an empty space on account of an increased degree of its layout freedom.

In the above arrangement, the oil supply inlet and the gage insertion tube may be disposed in respective positions on the crankcase cover that are in horizontal symmetry to each other.

With this arrangement, inasmuch as the oil supply inlet and the gage insertion tube being disposed in respective positions in the crankcase cover are in horizontal symmetry to each other, the oil supply inlet and the gage insertion tube are kept out of physical interference with each other and can be disposed in positions for easy maintenance. Therefore, their maintainability is increased.

In the above arrangement, the gage insertion tube may have an air bleeding hole defined in an upper portion thereof.

With this arrangement, as the air bleeding hole is defined in the upper portion of the gage insertion tube, when the oil level gage is inserted into the gage insertion tube, the surface of oil is prevented from varying due to trapped air, and the amount of oil can be measured accurately. In addition, the oil level gage can easily be inserted because no air pumping occurs when the oil level gage is inserted.

Advantageous Effects of the Invention

According to the present invention, since the horizontal oil supply passageway bent and extending substantially horizontally from the lower end of the oil supply inlet that extends obliquely downwardly from the oil supply port at the upper end is connected to the oil pan inlet port disposed in the position offset from the vertical plane including the oblique oil supply inlet, the substantially horizontal oil supply passageway is made elongate, and the horizontal oil supply passageway can be expected to keep oil therein. It is not necessary to introduce oil at a low rate so as to avoid overflowing, and hence the time required to supply oil can be reduced.

MODE FOR CARRYING OUT THE INVENTION

An embodiment of the present invention will hereinafter be described below with reference to FIGS. 1 through 8.

Figure 1:
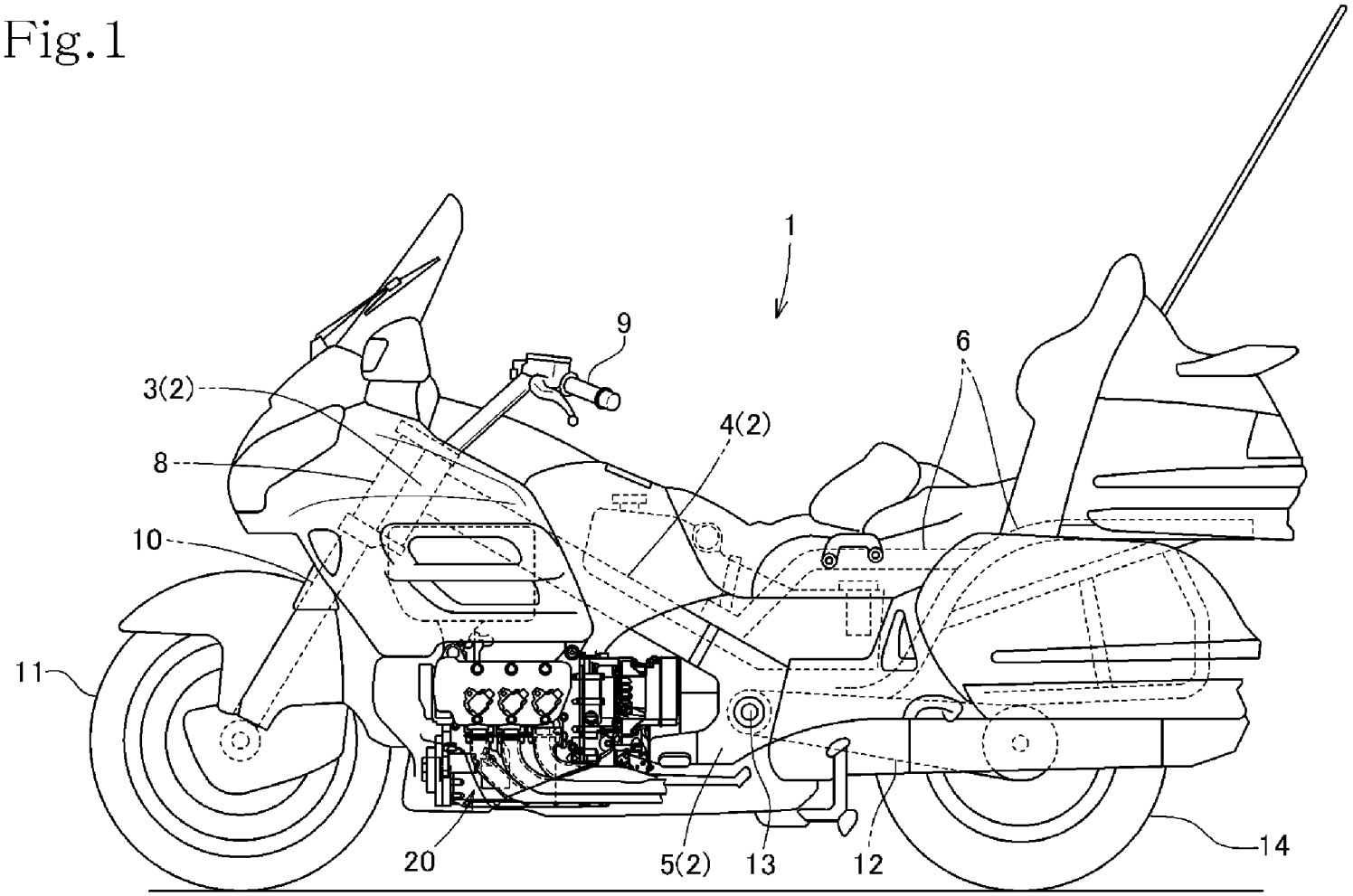
FIG. 1 is a left-hand side elevational view of a motorcycle incorporating an internal combustion engine according to an embodiment of the present invention.

FIG. 1 is a left-hand side elevational view of a motorcycle 1 of saddle-type incorporating an internal combustion engine according to the embodiment of the present invention.

In the description that follows, forward, rearward, leftward, and rightward directions and other similar directional expressions will be referred to conforming to the usual standards wherein the forward direction is the direction of the forward moving direction of the motorcycle 1 according to the present embodiment In the drawings, FR represents a forward direction, RR a rearward direction, LH a leftward direction, RH a rightward direction, and UP an upward direction.

The motorcycle 1 incorporates a horizontally opposed 6-cylinder, water-cooled 4-stroke internal combustion engine 20 oriented longitudinally of the motorcycle 1.

The motorcycle 1 includes a vehicle body frame 2 having a pair of left and right main frames 4 extending rearwardly and obliquely downwardly from a head pipe 3 on a front vehicle body portion, a pivot frame 5 connected to the rear ends of the main frames 4, and a seat frame 6 having a front end connected to the pivot frame 5 and extending rearwardly and obliquely upwardly from the front end and bent substantially horizontally and rearwardly.

A steering handle 9 is mounted on an upper portion of a steering stem 8 that is rotatably supported on the head pipe 3. A pair of left and right front fork members 10 extend obliquely forwardly and downwardly from the steering stem 8. A front wheel 11 is rotatably supported on the lower end of the front fork members 10.

A swing arm 12 has a front end pivotally supported on the pivot frame 5 by a pivot shaft 13. Rear wheels 14 are rotatably supported in a cantilevered fashion on the rear end of the swing arm 12 that is vertically swingable.

The internal combustion engine 20 is suspended beneath the main frames 4. The internal combustion engine 20 has an output shaft 43 extending rearwardly through the swing arm 12 into a gearbox, not depicted, disposed centrally between the rear wheels, i.e., left and right rear wheels 14, for transmitting power of the internal combustion engine 20 to the rear wheels 14.

Figure 2:
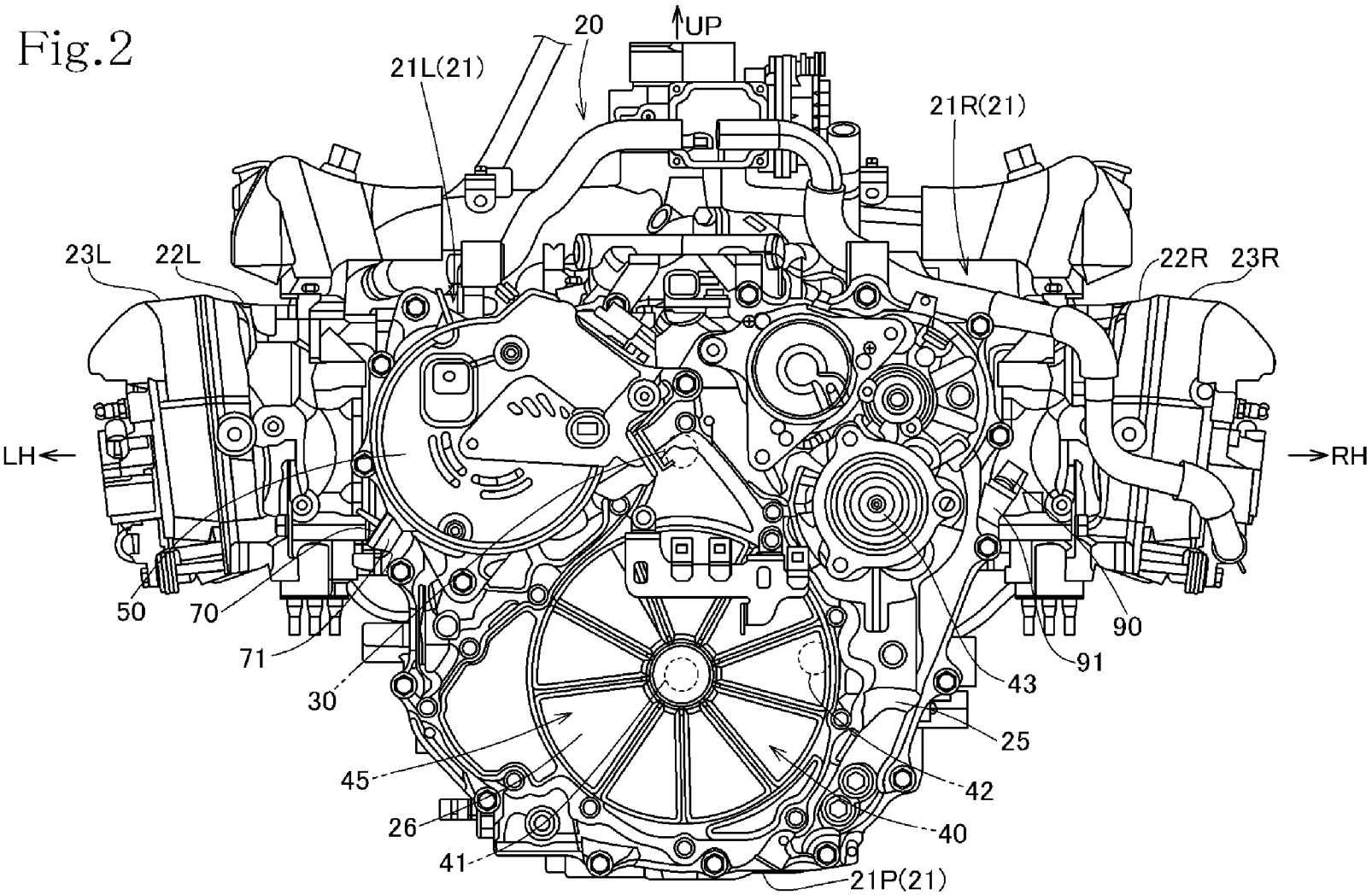
FIG. 2 is a rear elevational view of the internal combustion engine.
Figure 3:
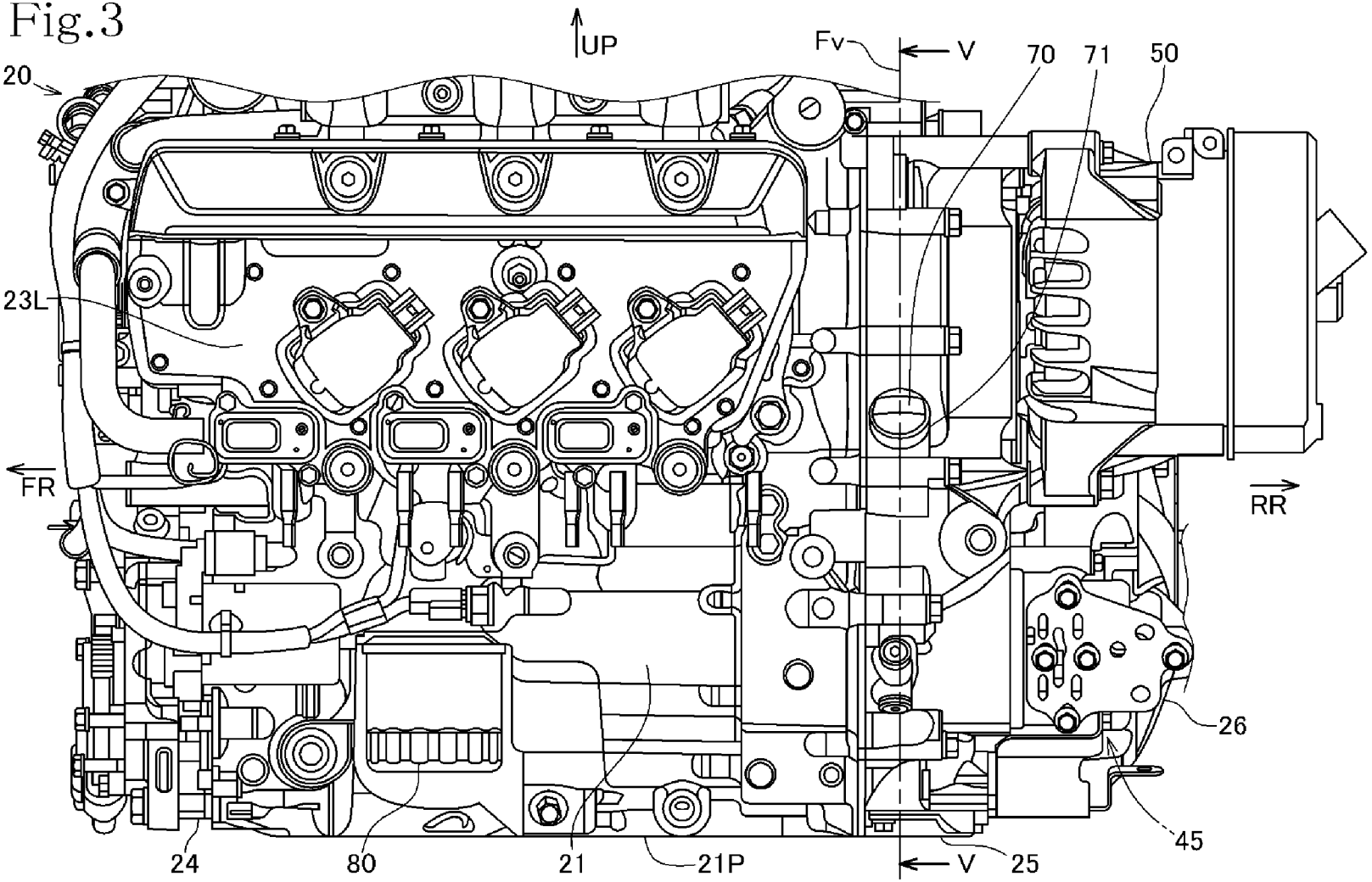
FIG. 3 is a left-hand side elevational view of the internal combustion engine.
Figure 4:
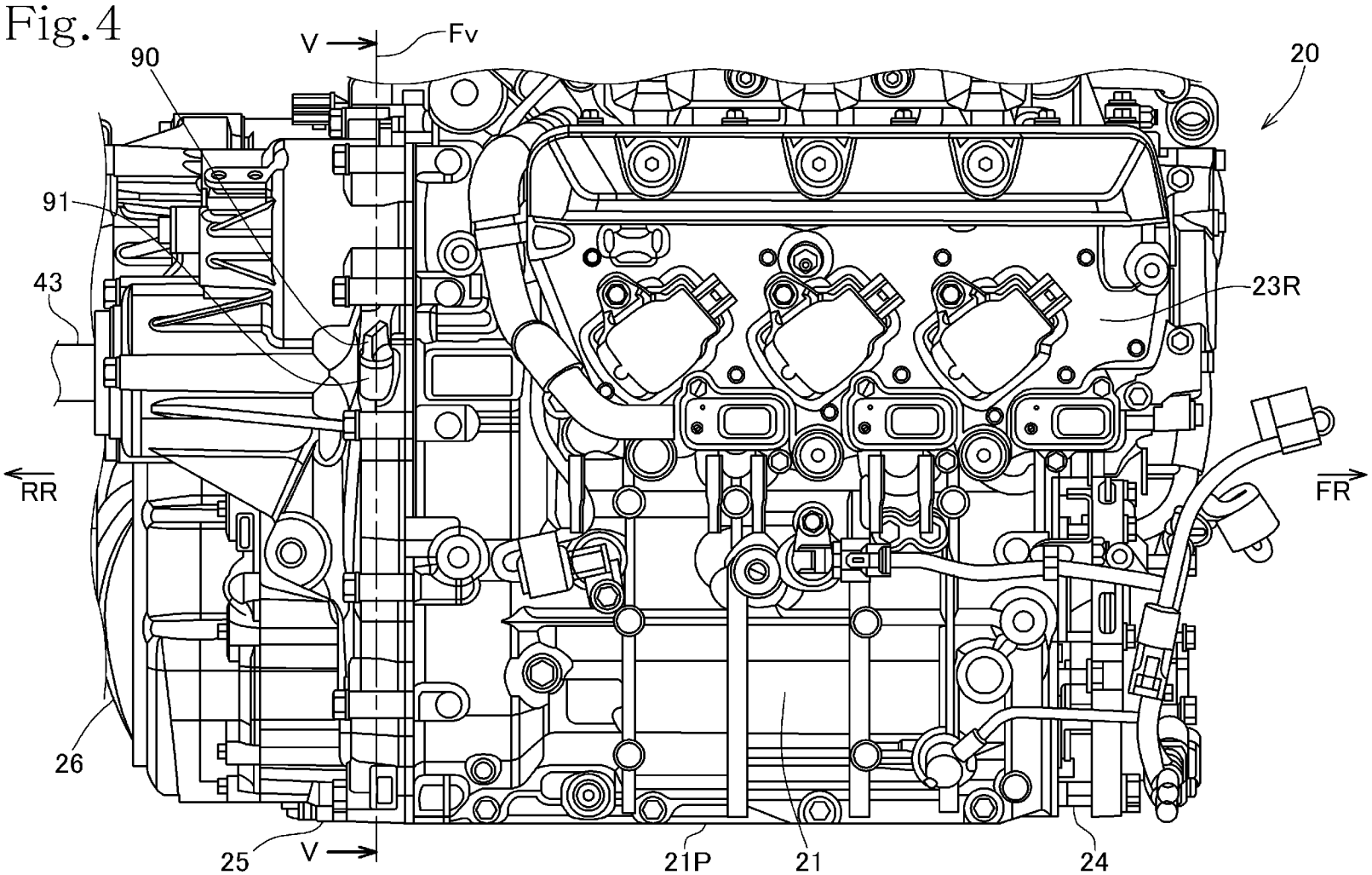
FIG. 4 is a right-hand side elevational view of the internal combustion engine.

FIG. 2 is a rear elevational view of the horizontally opposed 6-cylinder internal combustion engine 20. FIG. 3 is a left-hand side elevational view of the internal combustion engine 20. FIG. 4 is a right-hand side elevational view of the internal combustion engine 20.

The internal combustion engine 20 includes a crankcase 21 housing a crankshaft 30 oriented in forward and rearward directions and rotatably supported in an upper half portion thereof and also housing a multistage transmission 40 in a lower half portion thereof. The lower half portion has a bottom wall used as an oil pan 21P that defines an oil pan reservoir chamber Cp.

Figure 5:
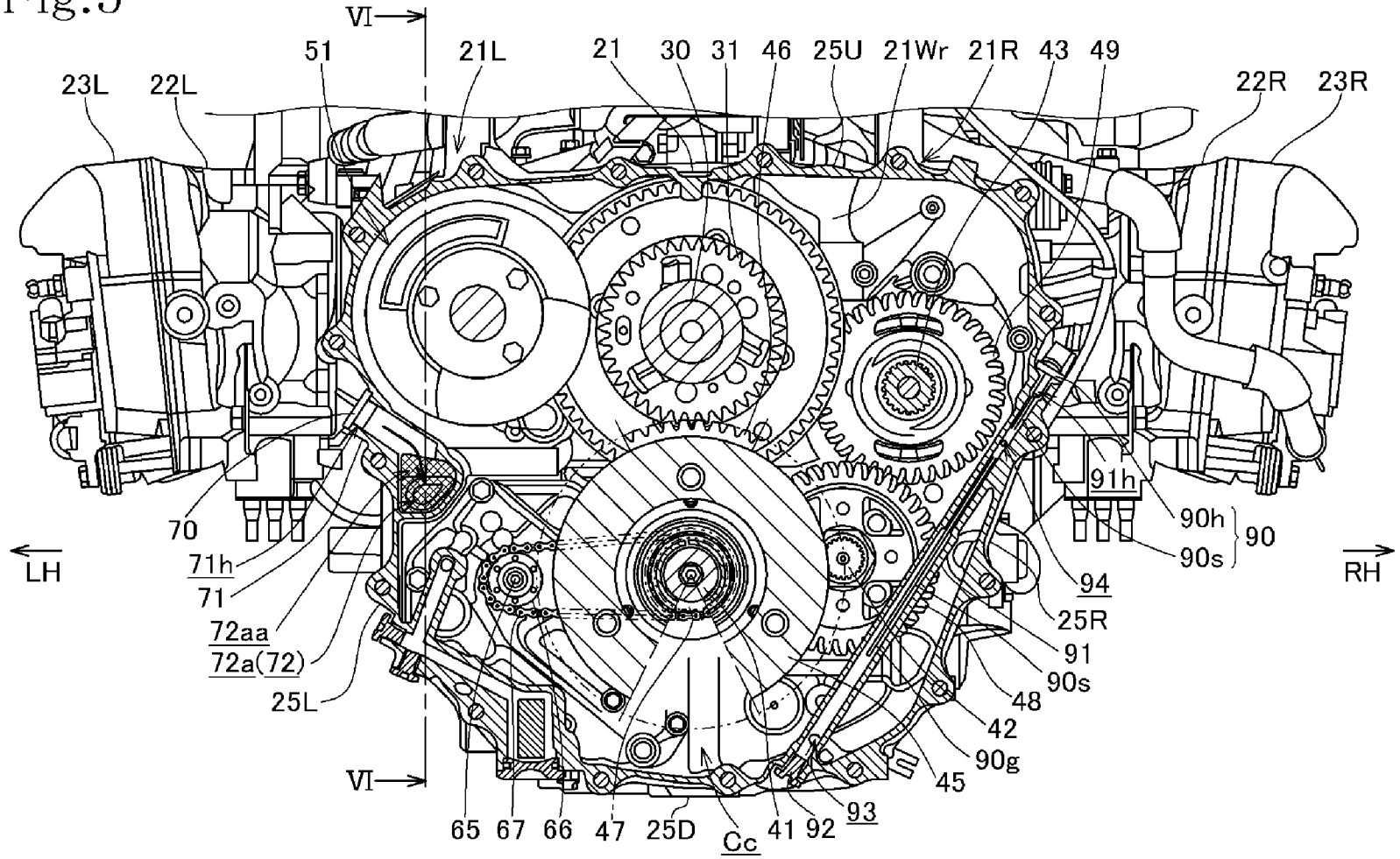
FIG. 5 is a cross-sectional view of the internal combustion engine taken along line V-V of FIGS. 3 and 4.

As illustrated in FIGS. 2 and 5, the upper half portion of the crankcase 21 includes a left cylinder portion 21L and a right cylinder portion 21R that project from a central portion housing the crankshaft 30 therein substantially horizontally to left and right sides.

Figure 6:
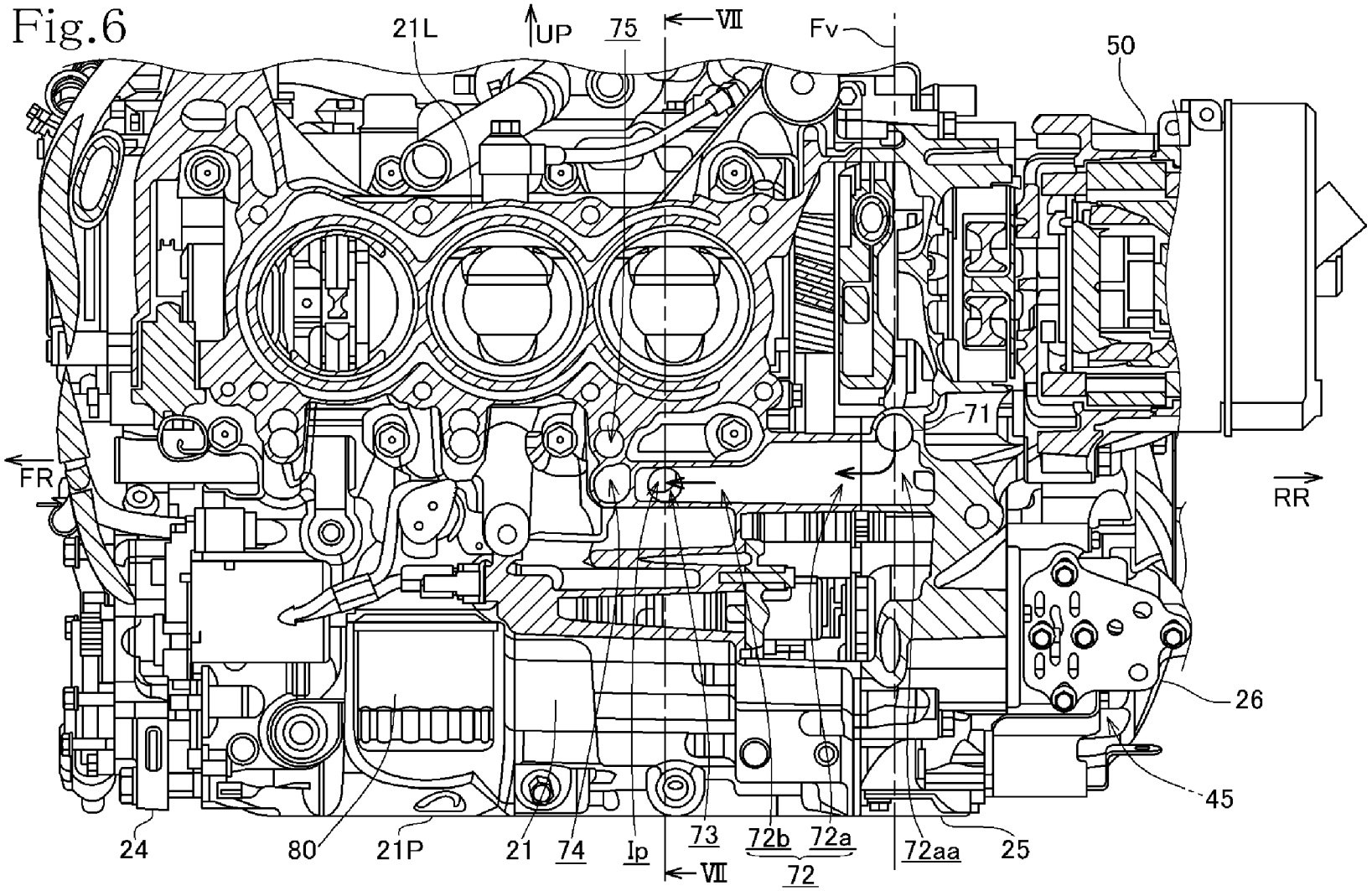
FIG. 6 is a cross-sectional view of the internal combustion engine taken along line VI-VI of FIG. 5.

Each the left cylinder portion 21L and the right cylinder portion 21R has three cylinders defined therein that are arrayed in the forward and rearward directions (see FIG. 6).

A left cylinder head 22L is stacked on and fastened to a left side of the left cylinder portion 21L, and a left cylinder head cover 23L covers a left side of the left cylinder head 22L.

Similarly, a right cylinder head 22R is stacked on and fastened to a right side of the right cylinder portion 21R, and a right cylinder head cover 23R covers a right side of the right cylinder head 22R.

As illustrated in FIGS. 3 and 4, a front crankcase cover 24 is stacked on and fastened to a front end face of the crankcase 21. A rear crankcase cover 25 is stacked on and fastened to a rear end face of the crankcase 21.

As illustrated in FIGS. 2 and 5, the transmission 40 that is housed in the lower half portion of the crankcase 21 includes a main shaft 41 positioned below the crankshaft 30 and a countershaft 42 positioned rightwardly of the main shaft 41.

The main shaft 41 and the countershaft 42 are oriented parallel to the crankshaft 30 in the forward and rearward directions.

The output shaft 43 is positioned obliquely upwardly of the countershaft 42.

A twin clutch 45 is mounted on a rear end of the main shaft 41 that extends rearwardly through the rear crankcase cover 25. The twin clutch 45 has a rear side covered with a clutch cover 26.

As illustrated in FIGS. 2 and 3, a starter generator 50 is mounted on a rear side of the rear crankcase cover 25 leftwardly and obliquely upwardly of the twin clutch 45.

FIG. 5 is a cross-sectional view of the internal combustion engine 20 taken along line V-V of FIGS. 3 and 4. FIG. 5 illustrates parts as viewed forwardly from a plane extending across the rear crankcase cover 25 perpendicularly to the axis of the crankshaft.

As illustrated in FIG. 5, the crankshaft 30, the main shaft 41, and the countershaft 42 project rearwardly through a rear partition wall 21Wr of the crankcase 21. The crankshaft 30 has a rearwardly projecting rear end over which a primary drive gear 31 is fitted, and the main shaft 41 has a rearwardly projecting shaft portion over which a primary driven gear 46 is fitted. The primary drive gear 31 and the primary driven gear 46 are held in mesh with each other. The countershaft 42 has a rearwardly projecting rear end over which a drive gear 48 is fitted, and a driven gear 49 is fitted over the output shaft 43. The drive gear 48 and the driven gear 49 are held in mesh with each other.

A driven sprocket 47 is fitted over the main shaft 41 in juxtaposed relation to the primary driven gear 46 (see FIG. 5).

Figure 8:
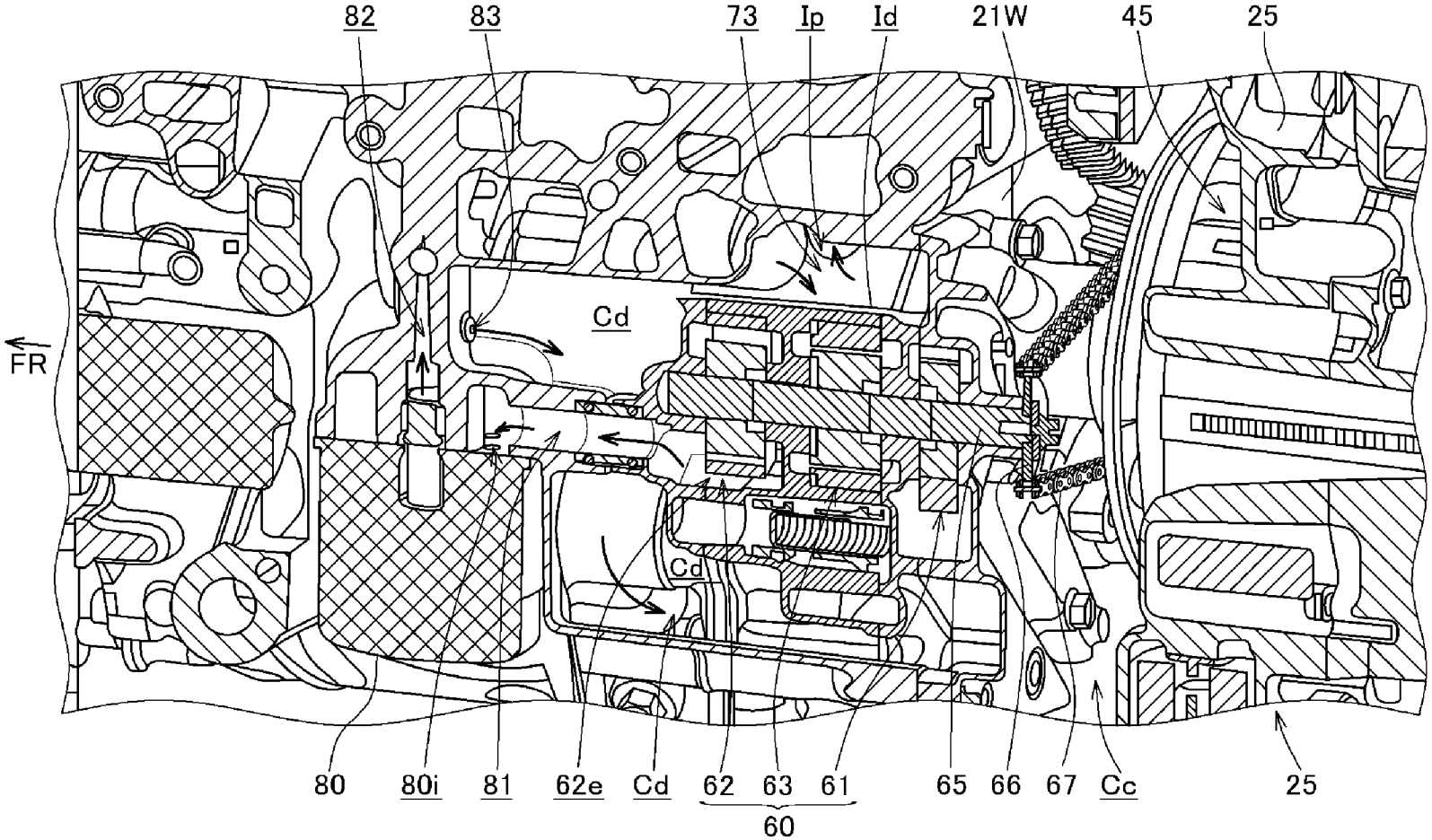
FIG. 8 is a sectional perspective view of the internal combustion engine taken along a vertical plane including the central axis of the pump drive shaft of an oil pump unit.

As illustrated in FIG. 8, an oil pump unit 60 is disposed in a left lower portion of the crankcase 21 along the rear partition wall 21Wr thereof. The oil pump unit 60 has a pump drive shaft 65 projecting rearwardly through the rear partition wall 21Wr. A driven sprocket 66 is fitted over a projecting rear end of the pump drive shaft 65.

As illustrated in FIG. 5, a chain 67 is trained around the drive sprocket 47 fitted over the main shaft 41 and the driven sprocket 66 fitted over the pump drive shaft 65. When the main shaft 41 is rotated, its rotation is transmitted through the chain 67 to the pump drive shaft 65 of the oil pump unit 60, actuating a pump of the oil pump unit 60.

A power transmitting mechanism 51 is disposed leftwardly of the primary drive gear 31 fitted over the rear end of the crankshaft 30. The power transmitting mechanism 51 has a shock absorbing function between the starter generator 50 and the crankshaft 30.

As illustrated in FIG. 5, the rear crankcase cover 25 includes a frame wall surrounding, from above, below, left, and right, the primary drive gear 31, the primary driven gear 46, the drive gear 48, the driven gear 49, the drive sprocket 47, the driven sprocket 66, the chain 67, and the power transmitting mechanism 51, etc. that are disposed behind and along the rear partition wall 21Wr of the crankcase 21. The frame wall is of a generally trapezoidal shape made up of a substantially horizontal, elongate upper frame wall portion 25U, a short lower frame wall portion 25D, a left frame wall portion 25L, and a right frame wall portion 25R.

The clutch cover 26 covers, from behind, the frame wall of the rear crankcase cover 25, defining a clutch chamber Cc therein.

The clutch chamber Cc houses therein the primary drive gear 31, the primary driven gear 46, the drive gear 48, the driven gear 49, the drive sprocket 47, the driven sprocket 66, the chain 67, and the power transmitting mechanism 51, etc. that are surrounded by the frame wall of the rear crankcase cover 25, together with the twin clutch 45.

As illustrated in FIG. 5, an oil supply inlet 71 for replenishing the oil pan reservoir chamber Cp with oil is disposed in the left frame wall portion 25L of the rear crankcase cover 25 obliquely downwardly of the power transmitting mechanism 51.

The oil supply inlet 71 has an oil supply port 71*h* defined in its upper end and being open outwardly, and extends obliquely downwardly from the oil supply port 71*h* to the right.

The oil supply port 71*h* of the oil supply inlet 71 is openably closed by a cap 70.

FIG. 5 is a cross-sectional view of the internal combustion engine 20 taken along line V-V of FIGS. 3, 4, and 6. FIG. 5 illustrates parts as viewed forwardly from a vertical plane Fv including the inclined oil supply inlet 71. A cross-sectional plane taken along line V-V corresponds to the vertical plane Fv including the inclined oil supply inlet 71.

As illustrated in FIGS. 5 and 6, the oil supply inlet 71 has a lower end from which an upstream horizontal oil supply passageway 72 is bent and extends horizontally forwardly. The upstream horizontal oil supply passageway 72 extends in and across the rear crankcase cover 25 and the crankcase 21 (see FIG. 6).

As illustrated in FIG. 6, the upstream horizontal oil supply passageway 72 includes an upstream passageway portion 72*a* connected to the oil supply inlet 71 and a downstream passageway portion 72*b*. The upstream passageway portion 72*a* and the downstream passageway portion 72*b* have different cross-sectional areas in that the downstream passageway portion 72*b* has a lower upper wall surface than the upstream passageway portion 72*a* and has a smaller cross-sectional area than the upstream passageway portion 72*a*.

Figure 7:
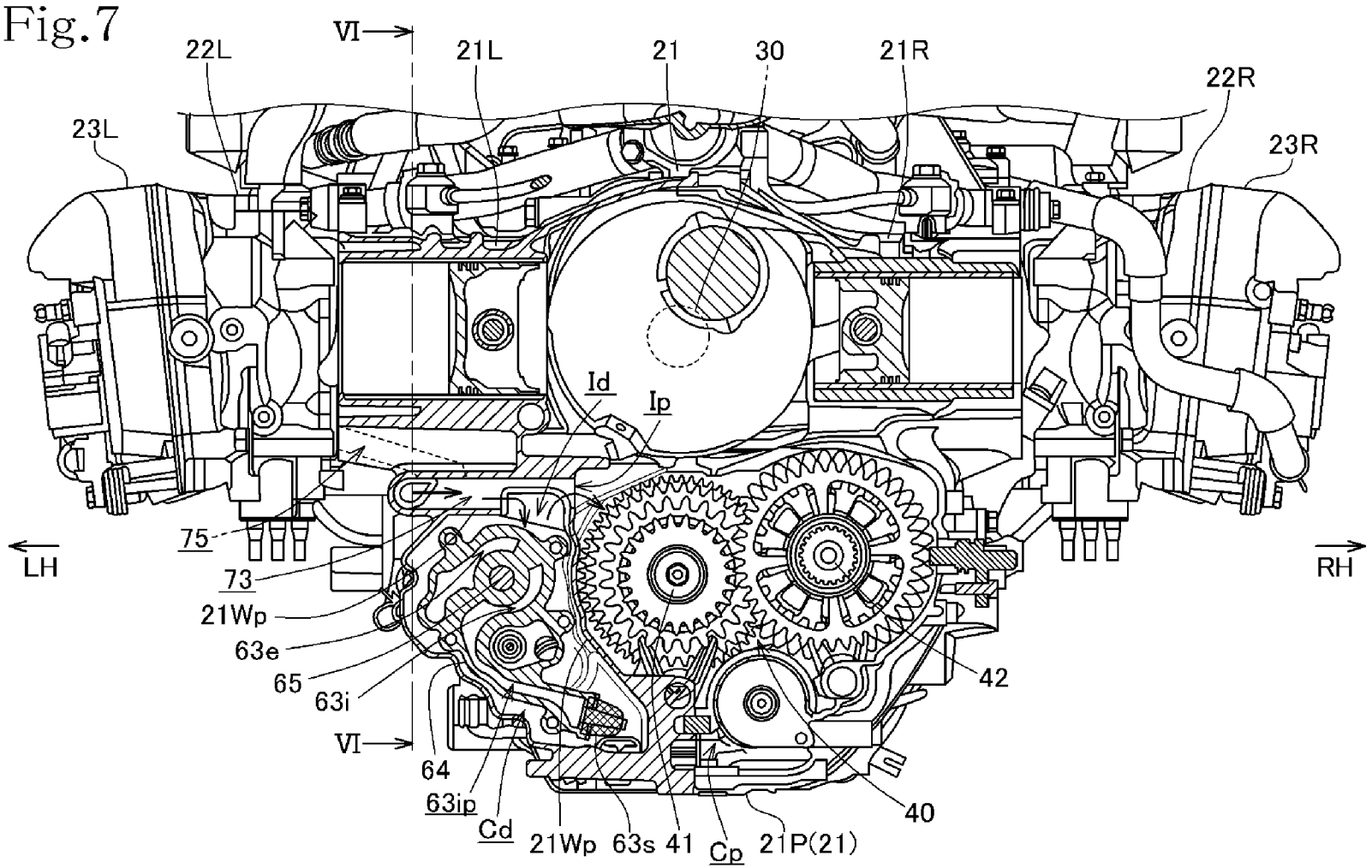
FIG. 7 is a cross-sectional view of the internal combustion engine taken along line VII-VII of FIG. 6.

As illustrated in FIGS. 6 and 7, the upstream horizontal oil supply passageway 72 has a front end as a downstream end held in fluid communication with a downstream horizontal oil supply passageway 73 that is bent and extends horizontally to the right.

As illustrated in FIG. 7, the downstream horizontal oil supply passageway 73 has a downstream end with an oil pan inlet port Ip defined in an end face thereof. The oil pan inlet port Ip is open into the oil pan reservoir chamber Cp of the oil pan 21P.

As illustrated in FIG. 6, since the upstream horizontal oil supply passageway 72 is bent and extends forwardly from the lower end of the oil supply inlet 71 and the oil pan inlet port Ip is positioned in the end face of the downstream end of the downstream horizontal oil supply passageway 73 that is bent to the right from the front end of the upstream horizontal oil supply passageway 72, the downstream horizontal oil supply passageway 73 and the oil pan inlet port Ip are disposed in a position that is offset forwardly from the vertical plane Fv including the inclined oil supply inlet 71.

As the oil supply inlet 71 and the oil pan inlet port Ip are offset from each other in the forward and rearward directions, the upstream horizontal oil supply passageway 72 is interposed and the horizontal oil supply passageways 72 and 73 are made elongate.

Therefore, when oil is introduced from the oil supply inlet 71, the horizontal oil supply passageways 72 and 73 can be expected to keep oil therein. It is not necessary to introduce oil at a low rate so as to avoid overflowing, and hence the time required to supply oil can be reduced.

As illustrated in FIG. 5, the upstream horizontal oil supply passageway 72 has an upstream end 72*aa* to which the oil supply inlet 71 is connected and whose cross-sectional plane, depicted cross-hatched in FIG. 5, is of a trapezoidal shape whose cross-sectional plane is of a trapezoidal shape having an upper side that is connected to the oil supply inlet 71 and longer than a lower side thereof.

Consequently, since oil that is introduced into the oil supply inlet 71 flows into the upstream end 72*aa*, whose cross-sectional plane is of a trapezoidal shape where the upper side is longer than the lower side, of the upstream horizontal oil supply passageway 72, the oil which contains air trapped when the oil is introduced is constricted by the upstream end 72*aa* whose cross-sectional plane is of a tapered trapezoidal shape. Air-oil separation is thus promoted, and the separated air is restrained from entering the upstream horizontal oil supply passageway 72.

Furthermore, as illustrated in FIG. 6, inasmuch as the upstream passageway portion 72*a* of the upstream horizontal oil supply passageway 72 is connected to the downstream passageway portion 72*b* that has a lower upper wall surface and a smaller cross-sectional area, even if air enters the upstream passageway portion 72*a* of the upstream horizontal oil supply passageway 72, the air is restrained from entering the downstream passageway portion 72*b* by a step where the upper wall surface is lower.

The shape of the upstream horizontal oil supply passageway 72 is thus able to prevent replenishing oil that contains air from entering the oil pan reservoir chamber Cp as much as possible.

As illustrated in FIG. 7, an oil return passageway 75 for returning oil that has lubricated a valve operating mechanism is connected to the downstream horizontal oil supply passageway 73 bent and extending to the right from the upstream horizontal oil supply passageway 72.

Therefore, as the oil return passageway 75 for returning oil that has lubricated the valve operating mechanism is joined to the downstream horizontal oil supply passageway 73, the downstream horizontal oil supply passageway 73 is used as part of the oil return passageway 75. As a result, the oil passageway system is simplified, making it possible to prevent the internal combustion engine from increasing in size.

The internal combustion engine 20 is a dual clutch transmission (DCT)-type internal combustion engine with the twin clutch 45, and has an operating oil pump 63 for supplying operating oil for operating the twin clutch 45.

As illustrated in FIG. 8, the oil pump unit 60 includes a scavenging pump 61, a lubricating pump 62, and the operating oil pump 63, which are actuated by the pump drive shaft 65 as a common pump drive shaft.

The scavenging pump 61 that is disposed rearwardly, the operating oil pump 63, and the lubricating pump 62 are successively arrayed forwardly.

The oil pump unit 60 with a pump housing 64 is disposed in an operating oil reservoir chamber Cd separated from the oil pan reservoir chamber Cp by a pump partition wall 21Wp (see FIGS. 7 and 8).

FIG. 7 is a cross-sectional view taken across the operating oil pump 63 disposed at the center. The pump housing 64 of the operating oil pump 63 is disposed in the operating oil reservoir chamber Cd.

The pump housing 64 of the operating oil pump 63 has an outlet port 63*e* and an inlet port 63*i* that are disposed leftwardly and rightwardly, respectively, of the pump drive shaft 65. An inlet passageway 63*ip* extends downwardly from the inlet port 63*i* and has a lower end opening capped with an oil strainer 63*s*. The oil strainer 63*s* is positioned along the bottom of the operating oil reservoir chamber Cd.

When the operating oil pump 63 is actuated, therefore, oil kept in the operating oil reservoir chamber Cd is filtered by the oil strainer 63*s*, and then the oil filtered is introduced through the inlet passageway 63*ip* into the inlet port 63*i* to be discharged into the outlet port 63*e*.

The oil discharged into the outlet port 63*e* is supplied through an oil pressure regulating device as operating oil to the twin clutch 45.

As illustrated in FIG. 7, the pump partition wall 21Wp that defines the operating oil reservoir chamber Cd housing the pump housing 64 therein includes an upper wall that corresponds to a lower wall of the downstream horizontal oil supply passageway 73. The operating oil reservoir chamber Cd has an operating oil reservoir chamber inlet port Id that is open in a downstream end portion of the lower wall of the downstream horizontal oil supply passageway 73.

Therefore, the oil pan inlet port Ip of the oil pan reservoir chamber Cp is open in the downstream end of the downstream horizontal oil supply passageway 73, and the operating oil reservoir chamber inlet port Id of the operating oil reservoir chamber Cd is open in front of the oil pan inlet port Ip.

Therefore, as illustrated in FIG. 7, oil that is introduced into the oil supply inlet 71 flows through the upstream horizontal oil supply passageway 72 and the downstream horizontal oil supply passageway 73 into the operating oil reservoir chamber Cd from the operating oil reservoir chamber inlet port Id, and replenishes and fills the operating oil reservoir chamber Cd.

As illustrated in FIGS. 7 and 8, the oil that has filled the operating oil reservoir chamber Cd overflows from the operating oil reservoir chamber inlet port Id and flows from the oil pan inlet port Ip into the oil pan reservoir chamber Cp of the oil pan 21P.

Accordingly, oil can replenish the oil pan reservoir chamber Cp while filling the operating oil reservoir chamber Cd.

The oil that has filled the operating oil reservoir chamber Cd is pumped up by the operating oil pump 63 and supplied to the twin clutch 45, actuating the twin clutch 45. Therefore, the oil is required to have a high oil pressure. The surface of the oil that has filled the operating oil reservoir chamber Cd is higher than the surface of oil in the oil pan reservoir chamber Cp, and can maintain the high pressure.

As illustrated in FIG. 8, an oil filter 80 is attached to the crankcase 21 from below forwardly of the oil pump unit 60. An outlet oil passageway 81 that extends forwardly from an outlet port 62*e* of the lubricating pump 62 for pumping up oil from within the oil pan reservoir chamber Cp is held in fluid communication with an inlet port 80*i* of the oil filter 80.

An outlet oil passageway 82 extends upwardly from the center of the oil filter 80 and is held in fluid communication with lubrication portions of the internal combustion engine 20 to supply oil thereto.

A fluid communication hole 83 is defined from a portion of the outlet oil passageway 82 and open into the operating oil reservoir chamber Cd.

Therefore, part of the oil supplied to the lubrication portions of the internal combustion engine 20 is supplied to the operating oil reservoir chamber Cd.

The scavenging pump 61 pumps up oil kept in the clutch chamber Cc and discharges the oil into the oil pan reservoir chamber Cp. The surface of the oil kept in the clutch chamber Cc is low enough not to exert resistance to rotation of the various gears and the twin clutch 45.

As illustrated in FIG. 5, a gage insertion tube 91 for the insertion of an oil level gage 90 therein is disposed in the right frame wall portion 25R of the frame wall, which is of a generally trapezoidal shape, of the rear crankcase cover 25.

The gage insertion tube 91 is positioned in substantially bilaterally symmetrical relation to the oil supply inlet 71.

The gage insertion tube 91 has at its upper end an insertion port 91*h* defined in the right frame wall portion 25R and being open outwardly. The gage insertion tube 91 extends from the insertion port 91*h* leftwardly and obliquely downwardly, and deviates at a portion thereof from the right frame wall portion 25R and reaches the lower frame wall portion 25D.

The gage insertion tube 91 has a lower-end opening closed by a plug 92 and has a fluid communication port 93 defined therein near the plug 92 and held in fluid communication with the oil pan reservoir chamber Cp.

The gage insertion tube 91 also has an air bleeding hole 94 defined therein at an upper position thereof slightly below the insertion port 91*h*. The air bleeding hole 94 is open into the clutch chamber Cc.

Because the fluid communication port 93 in the lower portion of the gage insertion tube 91 is held in fluid communication with the oil pan reservoir chamber Cp, oil kept in the oil pan reservoir chamber Cp and oil entered in the gage insertion tube 91 have respective surfaces at the same height.

When an elongate stick 90*s* of the oil level gage 90 is inserted into the gage insertion tube 91 and a head 90*h* with a knob is fitted to a predetermined position into the insertion port 91*h*, a gage member 90*g* near the tip end of the stick 90*s* is marked with the amount of oil in the oil pan reservoir chamber Cp.

In FIG. 5, the elongate stick 90*s* of the oil level gage 90 is partly omitted from illustration, and the air bleeding hole 94 is seen where the elongate stick 90*s* is partly omitted from illustration.

As the air bleeding hole 94 is defined in the upper portion of the gage insertion tube 91, when the oil level gage 90 is inserted into the gage insertion tube 91, the surface of oil is prevented from varying due to trapped air, and the amount of oil can be measured accurately. In addition, the oil level gage 90 can easily be inserted because no air pumping occurs when the oil level gage 90 is inserted.

With the internal combustion engine 20, since the gage insertion tube 91 for the insertion of the oil level gage 90 therein is disposed on the rear crankcase cover 25 separately from the oil supply inlet 71, the oil supply inlet 71 does not need to be set to a length equal or larger than the length of the oil level gage 90 and can be placed in an empty space on account of an increased degree of its layout freedom.

Inasmuch as the oil supply inlet 71 and the gage insertion tube 91 are disposed in respective positions in the crankcase cover 25 that are in horizontal symmetry to each other, the oil supply inlet 71 and the gage insertion tube 91 are kept out of physical interference with each other and can be disposed in positions for easy maintenance. Therefore, their maintainability is increased.

The internal combustion engine according to the above embodiment is a DCT-type internal combustion engine with the twin clutch 45. An internal combustion engine of another type which is of the same basic structure will hereinafter described below with reference to FIGS. 9 and 10.

An internal combustion engine 100 to be described below is a manual transmission (MT)-type internal combustion engine with a manual clutch, and hence is free of a hydraulically operated twin clutch and an operating oil pump.

The internal combustion engine 100 is of almost the same structure as the internal combustion engine 20. The DCT-type internal combustion engine and the MT-type internal combustion engine can easily be manufactured distinctly from each other by machining part of crankcases of a basic configuration.

Those parts and portions of the internal combustion engine 100 which are identical to those of the internal combustion engine 20 will be denoted by identical reference characters.

Figure 9:
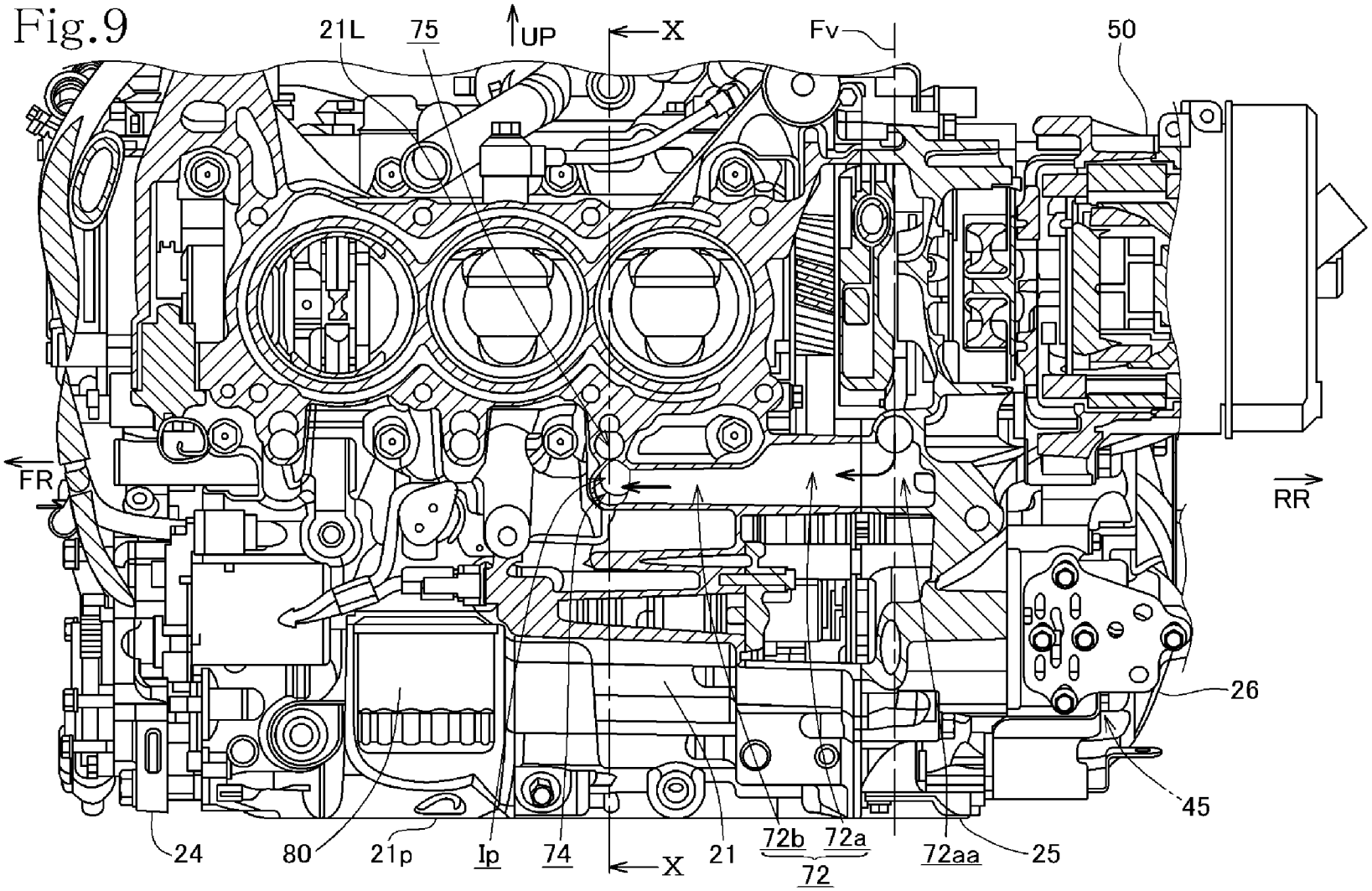
FIG. 9 is a cross-sectional view, which corresponds to FIG. 6, of an internal combustion engine of another type.
Figure 10:
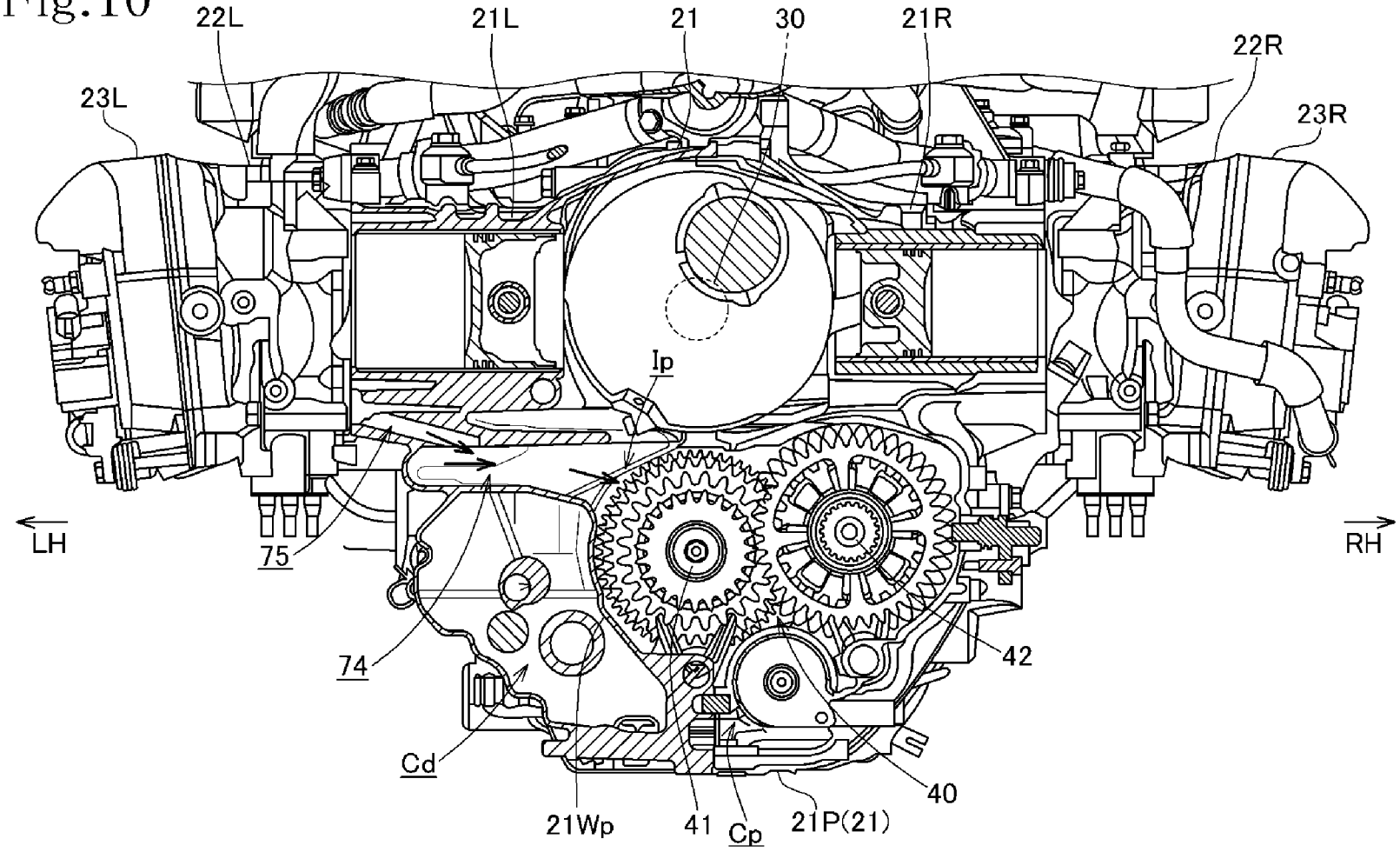
FIG. 10 is a cross-sectional view, which corresponds to FIG. 7, of the internal combustion engine taken along line X-X of FIG. 9.

FIG. 9 is a cross-sectional view, which corresponds to FIG. 6 illustrating the internal combustion engine 20, of the internal combustion engine 100, and FIG. 10 is a cross-sectional view, which corresponds to FIG. 7 illustrating the internal combustion engine 20, of the internal combustion engine 100 taken along line X-X of FIG. 9.

As illustrated in FIG. 9, taken in comparison with FIG. 6, the downstream horizontal oil supply passageway 73 (see FIG. 6) bent to the right from and connected to the upstream horizontal oil supply passageway 72 in the internal combustion engine 20 is replaced with a downstream horizontal oil supply passageway 74 (see FIG. 9) positioned further forwardly in the internal combustion engine 100, with the upstream horizontal oil supply passageway 72 being connected to the downstream horizontal oil supply passageway 74.

The downstream horizontal oil supply passageway 73 and the downstream horizontal oil supply passageway 74 have been originally defined, and they are joined to each other on a downstream side.

The oil return passageway 75 is joined to the downstream horizontal oil supply passageway 74 (see FIG. 10).

In the internal combustion engine 20 described above, the upstream horizontal oil supply passageway 72 and the downstream horizontal oil supply passageway 73 are connected to each other by removing a partition wall therebetween. In the internal combustion engine 100, the upstream horizontal oil supply passageway 72 and the downstream horizontal oil supply passageway 74 are connected to each other by removing a partition wall therebetween.

As illustrated in FIG. 10, taken in comparison with FIG. 7, the operating oil pump 63 in the internal combustion engine 20 is dispensed with in the internal combustion engine 100, and whereas the upper wall of the pump partition wall 21Wp that defines the operating oil reservoir chamber Cd in the internal combustion engine 20 is partly removed to define the operating oil reservoir chamber inlet port Id (see FIG. 7) of the operating oil reservoir chamber Cd, the upper wall of the pump partition wall 21Wp, which corresponds to the lower wall of the downstream horizontal oil supply passageway 74, in the internal combustion engine 100 is not partly removed, with the operating oil reservoir chamber Cd being separate from the downstream horizontal oil supply passageway 74.

Therefore, oil introduced into the oil supply inlet 71 flows directly from the oil pan inlet port Ip into the oil pan reservoir chamber Cp, rather than flowing through the upstream horizontal oil supply passageway 72 and the downstream horizontal oil supply passageway 73 into the operating oil reservoir chamber Cd.

As described above, the DCT-type internal combustion engine and the MT-type internal combustion engine can easily be manufactured distinctly from each other by machining part of crankcases of a basic configuration.

Since the oil supply inlet 71 is disposed in the rear crankcase cover 25 and the upstream horizontal oil supply passageway 72 bent and extending horizontally from the lower end of the oil supply inlet 71 extends in and across the crankcase 21 and the rear crankcase cover 25 coupled to the crankcase 21, the crankcase 21 can easily be machined to remove part of the wall of the upstream horizontal oil supply passageway 72, for example, and alterations can easily be made depending on different shapes of portions of the oil passageway system.

While the internal combustion engines according to the embodiments of the present invention have been described above, the present invention is not limited to the above embodiments, but may be reduced to practice with various many changes and modifications within the scope of the invention.

For example, the vehicle according to the present invention is not limited to the saddle-type motorcycle 1 according to the embodiments, but may be any of various saddle-type vehicles including scooter-type vehicles, three-wheeled and four-wheeled buggies, etc. insofar as they incorporate the requirements of claim 1.

REFERENCE SIGNS LIST

1 . . . Motorcycle, 2 . . . Vehicle body frame, 3 . . . Head pipe, 4 . . . Main frame, 5 . . . Pivot frame, 6 . . . Seat frame, 7 . . . , 8 . . . Steering stem, 9 . . . Handle, 10 . . . Front fork, 11 . . . Front wheel, 12 . . . Swing arm, 13 . . . Pivot shaft, 14 . . . Rear wheel,

20 . . . Internal combustion engine, 21 . . . Crankcase, 21L . . . Left cylinder portion, 21R . . . Right cylinder portion, 21P . . . Oil pan, 21Wr . . . Rear partition wall, 21Wp . . . Pump partition wall, 22L . . . Left cylinder head, 22R . . . Right cylinder head, 23L . . . Left cylinder head cover, 23R . . . Right cylinder head cover, 24 . . . Front crankcase cover, 25 . . . Rear crankcase cover,

30 . . . Crankshaft, 31 . . . Primary drive gear,

40 . . . Transmission, 41 . . . Main shaft, 42 . . . Countershaft, 43 . . . Output shaft, 45 . . . Twin clutch, 46 . . . Primary driven gear, 47 . . . Drive sprocket, 48 . . . Drive gear, 49 . . . Driven gear,

50 . . . Starter generator, 51 . . . Power transmitting mechanism,

60 . . . Oil pump unit, 61 . . . Scavenging pump, 62 . . . Lubricating pump, 63 . . . Operating oil pump, 64 . . . Pump housing, 66 . . . Driven sprocket, 67 . . . Chain,

70 . . . Cap, 71 . . . Oil supply inlet, 71*h* . . . Oil supply port, 72 . . . Upstream horizontal oil supply passageway, 72*a* . . . Upstream passageway portion, 72*aa* . . . Upstream end, 72*b* . . . Downstream passageway portion, 73 . . . Downstream horizontal oil supply passageway, 74 . . . Downstream horizontal oil supply passageway, 75 . . . Oil return passageway,

80 . . . Oil filter, 81 . . . Outlet oil passageway, 82 . . . Outlet oil passageway,

90 . . . Oil level gage, 91 . . . Gage insertion tube, 92 . . . Plug, 93 . . . Fluid communication port, 94 . . . Air bleeding hole, Cp . . . Oil pan reservoir chamber, Ip . . . Oil pan inlet port, Cd . . . Operating oil reservoir chamber, Id . . . Operating oil reservoir chamber inlet port, Cc . . . Clutch chamber,

100 . . . Internal combustion engine

The invention claimed is:

1. An internal combustion engine having an oil supply inlet for replenishing, with oil, an oil pan reservoir chamber disposed in a lower portion of a crankcase, the oil supply inlet extending obliquely downwardly from an oil supply port at an upper end thereof, wherein the oil pan reservoir chamber has an oil pan inlet port disposed in a position offset from a vertical plane including the oblique oil supply inlet, a horizontal oil supply passageway bent and extending substantially horizontally from a lower end of the oil supply inlet is connected to the oil pan inlet port, the oil supply inlet is disposed in a crankcase cover coupled to the crankcase, and the horizontal oil supply passageway extends in and across the crankcase cover and the crankcase.

2. The internal combustion engine as claimed in claim 1, wherein an oil return passage for returning oil that has lubricated lubrication portions of the internal combustion engine is joined to the horizontal oil supply passageway.

3. The internal combustion engine as claimed in claim 1, including an operating oil reservoir chamber separately from the oil pan reservoir chamber, wherein the horizontal oil supply passageway has an operating oil reservoir chamber inlet port defined in a downstream end thereof and leading to the operating oil reservoir chamber, separately from the oil pan inlet port.

4. The internal combustion engine as claimed in claim 1, wherein a gage insertion tube for insertion of an oil level gage therein is disposed in the crankcase cover, separately from the oil supply inlet.

5. The internal combustion engine as claimed in claim 4, wherein the oil supply inlet and the gage insertion tube being disposed in respective positions on the crankcase cover are in horizontal symmetry to each other.

6. The internal combustion engine as claimed in claim 4, wherein the gage insertion tube has an air bleeding hole defined in an upper portion thereof.

7. An internal combustion engine having an oil supply inlet for replenishing, with oil, an oil pan reservoir chamber disposed in a lower portion of a crankcase, the oil supply inlet extending obliquely downwardly from an oil supply port at an upper end thereof, wherein:

the oil pan reservoir chamber has an oil pan inlet port disposed in a position offset from a vertical plane including the oblique oil supply inlet, a horizontal oil supply passageway bent and extending substantially horizontally from a lower end of the oil supply inlet is connected to the oil pan inlet port, the oil supply inlet is disposed in a crankcase cover coupled to the crankcase, and the horizontal oil supply passageway extends in and across the crankcase cover and the crankcase, wherein the horizontal oil supply passageway has an upstream end to which the oil supply inlet is connected, and wherein a cross-sectional plane of the upstream end is of a trapezoidal shape having an upper side, connected to the oil supply inlet, longer than a lower side thereof.

8. The internal combustion engine as claimed in claim 7, wherein the horizontal oil supply passageway has an upstream passageway portion near an upstream end thereof, the upstream passageway portion being connected to a downstream passageway portion having a lower upper wall surface and a smaller cross-sectional area.

9. The internal combustion engine as claimed in claim 7, wherein an oil return passage for returning oil that has lubricated lubrication portions of the internal combustion engine is joined to the horizontal oil supply passageway.

10. The internal combustion engine as claimed in claim 7, including an operating oil reservoir chamber separately from the oil pan reservoir chamber, wherein the horizontal oil supply passageway has an operating oil reservoir chamber inlet port defined in a downstream end thereof and leading to the operating oil reservoir chamber, separately from the oil pan inlet port.

11. An internal combustion engine having an oil supply inlet for replenishing, with oil, an oil pan reservoir chamber disposed in a lower portion of a crankcase, the oil supply inlet extending obliquely downwardly from an oil supply port at an upper end thereof, wherein:

the oil pan reservoir chamber has an oil pan inlet port disposed in a position offset from a vertical plane including the oblique oil supply inlet, a horizontal oil supply passageway bent and extending substantially horizontally from a lower end of the oil supply inlet is connected to the oil pan inlet port, the oil supply inlet is disposed in a crankcase cover coupled to the crankcase, and the horizontal oil supply passageway extends in and across the crankcase cover and the crankcase, wherein the horizontal oil supply passageway has an upstream passageway portion near an upstream end thereof, the upstream passageway portion being connected to a downstream passageway portion having a lower upper wall surface and a smaller cross-sectional area.

12. The internal combustion engine as claimed in claim 11, wherein an oil return passage for returning oil that has lubricated lubrication portions of the internal combustion engine is joined to the horizontal oil supply passageway.

13. The internal combustion engine as claimed in claim 11, including an operating oil reservoir chamber separately from the oil pan reservoir chamber, wherein the horizontal oil supply passageway has an operating oil reservoir chamber inlet port defined in a downstream end thereof and leading to the operating oil reservoir chamber, separately from the oil pan inlet port.

* * * * *